United States Patent [19]

Kaneko et al.

[11] Patent Number: 4,692,031

[45] Date of Patent: Sep. 8, 1987

[54] MOON PHASE DISPLAY CLOCK

[75] Inventors: Koichi Kaneko; Masado Hanya, both of Tokyo, Japan

[73] Assignee: Seikosha Co., Ltd., Tokyo, Japan

[21] Appl. No.: 876,990

[22] Filed: Jun. 19, 1986

[30] Foreign Application Priority Data

Jun. 20, 1985 [JP] Japan ..... 60-93786[U]

[51] Int. Cl.[4] ..... G04B 19/26

[52] U.S. Cl. ..... 368/18

[58] Field of Search ..... 568/15-20, 568/191

[56] References Cited

U.S. PATENT DOCUMENTS

| | | | |
|---|---|---|---|
| 1,187,110 | 6/1916 | Olsen | 368/17 |
| 1,997,511 | 4/1935 | Canepa | 368/18 |
| 2,359,458 | 10/1944 | Amend, Jr. et al. | 368/191 |
| 3,731,083 | 3/1973 | Jauch | 368/18 |
| 3,815,353 | 6/1974 | Wuthrich et al. | 368/191 |
| 3,837,161 | 9/1974 | Wuthrich | 368/191 |
| 4,548,512 | 10/1985 | Erard | 368/18 |

*Primary Examiner*—Vit W. Miska

*Attorney, Agent, or Firm*—Bruce L. Adams; Van C. Wilks

[57] ABSTRACT

A clock for indicating moon phase comprises a moon phase dial fixed to a hub rotatable around an axle for indicating the moon phase according to the angular position thereof relative to the axle. The moon phase dial has a set of circumferentially spaced peripheral projections manually engageable during correction of the angular position thereof. A moon phase gear is slideably disposed around the hub and is driven to continuously rotate around the axle at a rotation period related to the moon phase period. A slip mechanism is disposed between the moon phase dial and the moon phase gear and frictionally engages between the face of the moon phase gear which is opposed to the moon phase dial and the periphery of the hub. The slip mechanism is operative during the correction of the angular position of the moon phase dial for decoupling the moon phase gear from the hub so as to enable the moon phase dial to rotate independently of the moon phase gear, and operative during the normal operation of the clock for coupling the moon phase gear to the hub so as to enable the moon phase dial to continuously rotate in response to the rotation of the moon phase gear.

8 Claims, 4 Drawing Figures

MOON PHASE DISPLAY CLOCK

BACKGROUND OF THE INVENTION

The present invention relates to a clock provided with a moon phase display function.

An example of the structure of a conventional moon phase display clock is shown in FIG. 4. An hour pinion 21 is attached to an hour pipe 20 to which an hour hand is attached, and this hour pinion is engaged with an intermediate wheel 22. A pin 23 is implanted on one surface of the intermediate wheel 22 so as to drive a moon phase plate 24 at one step during one complete rotation of the intermediate wheel. A click spring 25 is engaged with the moon phase plate 24. The intermediate wheel 22 rotates at a period of 24 hours, and during each complete rotation, the pin 23 drives the moon phase plate 24 by one pitch or step. The reference numeral 26 denotes a display.

In the above-described conventional clock, since the moon phase plate 24 is driven by the pin 23, when the moon phase plate is corrected, it is inconveniently impossible to manually rotate the moon phase plate while the pin is engaged with the moon phase plate. Furthermore, since the indication of the moon phase changes every day in a comparatively short time period, it is not ensured that the exact moon phase for the time period is always displayed.

SUMMARY OF THE INVENTION

Accordingly, it is an object of the present invention to overcome the above-described defects in the prior art, and to provide a moon phase display clock in which the moon phase plate is continuously rotated and the manual correction of the moon phase plate is effected by providing a slip mechanism.

BRIEF DESCRIPTION OF THE DRAWINGS

FIGS. 1 to 3 show an embodiment of the present invention wherein

FIG. 1 is a side elevational view of a slip mechanism;

FIG. 2 is an elevational view of the structure of a moon phase display; clock FIG. 3 is a side elevational view thereof.

DETAILED DESCRIPTION OF PREFERRED EMBODIMENTS

Figure 1:
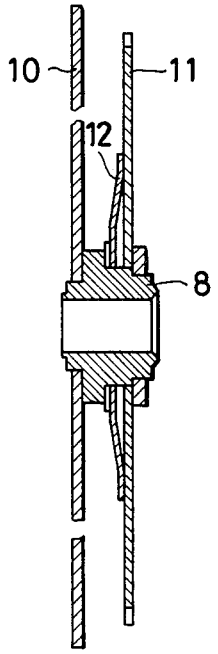
Figure 2:
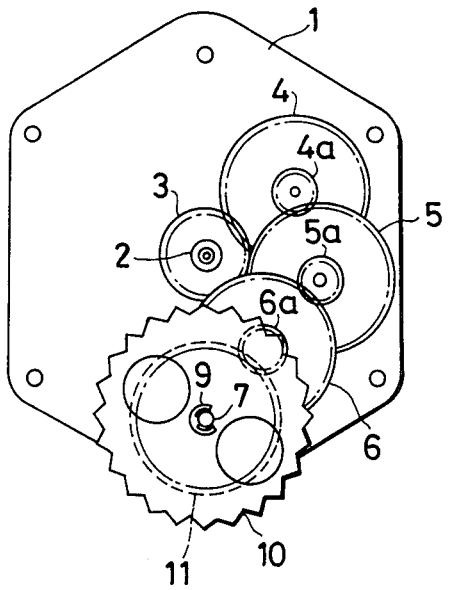
Figure 3:
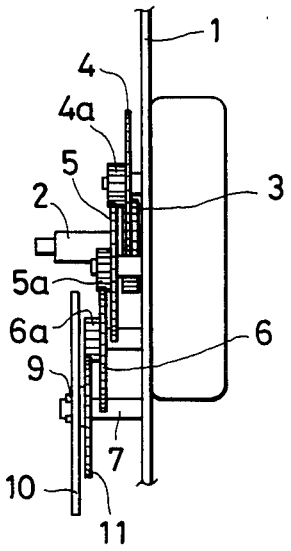
Figure 4:
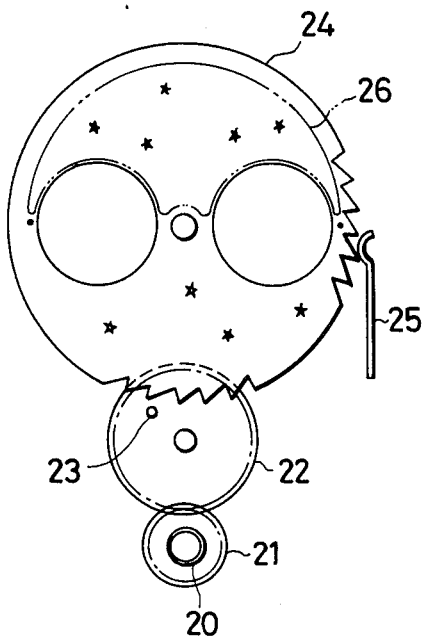
FIG. 4 is an elevational view of the main part of a conventional clock.

Referring to FIGS. 2 and 3, an hour pipe or shaft 2 protrudes from a base 1 and an hour pinion 3 is fit around the hour pipe 2. Intermediate wheels or gears 4, 5 and 6 have the same configuration and are integrally provided with intermediate pinions 4*a*, 5*a*, and 6*a*, respectively to constitute an intermediate gear train composed of a plurality of gear-and-pinion units. A moon phase washer or hub 8 is rotatably supported about a moon phase pipe or axle 7 protruding from the base 1 by an E ring 9. As shown in FIG. 1, a moon phase plate or dial is fixed to the washer 8, which rotatably and slideably supports a moon phase wheel or gear 11, and a slip mechanism in the form of a slip spring 12 is inserted between the moon phase plate 10 and the moon phase wheel 11 and frictionally engaged between one face of the moon phase wheel 11 and the periphery of the washer 8.

The rotation of the hour pipe 2 is transmitted to the moon phase wheel 11 through a reduction gear train comprised of the hour pinion 3 and the intermediate wheels 4,5 and 6, and the rotation of the moon phase wheel is ordinarily transmitted to the washer 8 through a coupling between the moon phase wheel 11 and the washer 8 by a sliding or frictional load of the slip spring 12, thereby continuously rotating the moon phase plate 10 during the normal operation. During manually correcting the angular position of the moon phase plate 10 relative to the moon phase pipe 7 by manually driving a set of circumferentially spaced peripheral projections on the moon phase plate 10, the washer 8 and the slip spring 12 slip, thereby decoupling the moon phase wheel 11 from the washer 8 and preventing any rotation of the moon phase wheel 11.

Suppose that the moon phase plate 10 is rotated at a period of 59 days related to the moon phase period. Since the cannon hour pinion 2 rotates at a period shorter than the rotational period of the moon phase wheel 11 and, for example, makes two clock revolutions per day, the reduction ratio between the hour pipe 2 and the moon phase wheel 11 is 1:118. Therefore, the ratio of the numbers of teeth between the hour pinion 3 and the moon phase wheel 11 is determined according to the following relation:

$$\frac{1}{\text{hour pinion}} \times \frac{\text{intermediate wheel 4}}{\text{intermediate pinion 4}a} \times \frac{\text{intermediate wheel 5}}{\text{intermediate pinion 5}a} \times \frac{\text{intermediate wheel 6}}{\text{intermediate pinion 6}a} \times \frac{\text{moon phase wheel 11}}{1} = 118 \quad (1)$$

If it is assumed that the moon phase wheel 11 has 59m teeth and the hour pinion 3 has 32m teeth, and the numbers of teeth of the intermediate wheels 4, 5, 6 and the numbers of teeth of the intermediate pinions 4*a*, 5*a* and 6*a* are common, respectively, and the reduction ratio is 1/n, the relation 11 can be rewritten as:

$$\frac{1}{mn^{32}} \times \frac{nx}{x} \times \frac{nx}{x} \times \frac{nx}{x} \times \frac{59m}{1} = 118 \quad (2)$$

($m$, $n$ and $x$ are integers)

In order to dispense with the use of a large wheel, if the numbers of teeth of the intermediate wheels 4, 5 and 6 and the intermediate pinions 4*a*, 5*a* and 6*a* and the moon phase wheel 17 are set so as not to exceed 100, the ratio of teeth is limited to the following case:

$$\frac{1}{32} \times \frac{4x}{x} \times \frac{4x}{x} \times \frac{4x}{x} \times \frac{59}{1} = 118 \quad (3)$$

(1 and 4 are substituted for the $m$ and $n$, respectively in the formula (2))

A positive integer not greater than 25 is substituted for x in the formula (3).

For example, if x=15 in the formula (3), the formula (4) is obtained:

$$\frac{1}{32} \times \frac{60}{15} \times \frac{60}{15} \times \frac{60}{15} \times \frac{59}{1} = 118 \quad (4)$$

(Advantages of the Invention)

According to the moon phase display clock having the above-described structure, there is no time period during which manual correction of the moon phase plate is impossible, and the moon phase plate is continuously rotated, thereby enabling the exact display of a moon phase.

What is claimed is:

1. A clock for indicating the moon phase comprising: a base; an axle projecting from the base; a hub rotatably supported on the axle; a moon phase dial fixed to the hub for indicating the moon phase according to the angular position thereof relative to the axle, the moon phase dial having a set of circumferentially spaced projections around the periphery thereof which are manually engageable to effect correction of the angular position of the moon phase dial; a moon phase gear slideably disposed around the hub in spaced relation from the moon phase dial and being driven to continuously rotate around the axle at a period of rotation related to the period of the moon phase; a slip mechanism disposed between the moon phase dial and the moon phase gear and frictionally and directly engaged between the face of the moon phase gear which opposes the moon phase dial and the periphery of the hub, the slip mechanism having means operative during the correction of the angular position of the moon phase dial for decoupling the moon phase gear from the hub to enable the moon phase dial to be manually rotated independently of the moon phase gear, and operative during the normal operation of the clock for coupling the moon phase gear to the hub to enable the moon phase dial to be continuously rotated in response to the rotation of the moon phase gear; an hour shaft protruding from the base and driven to undergo a clock rotation at a period of rotation shorter than the period of rotation of the moon phase gear; and a reduction gear train connected between the hour shaft and the moon phase gear for continuously transmitting the clock rotation of the hour shaft to the moon phase gear at a reduction rate corresponding to the ratio of the moon phase gear rotation period to the hour shaft rotation period.

2. A clock according to claim 1; wherein the reduction gear train comprises an hour pinion fixed around the hour shaft, and an intermediate gear train connected between the hour pinion and the moon phase gear.

3. A clock according to claim 2; wherein the moon phase gear is configured to rotate at a period of 58 days, the hour shaft is configured to rotate at a period of half a day, and the reduction gear train has a reduction rate of 118:1.

4. A clock according to claim 3; wherein the hour pinion has 32 teeth, the moon phase gear has 59 teeth, and the intermediate gear train has a reduction rate of 64:1.

5. A clock according to claim 2; wherein the intermediate gear train comprises a plurality of series-connected gear-and-pinion units each composed of a gear and a pinion coaxially integrated with each other.

6. A clock according to claim 5; wherein the gear-and-pinion units have the same reduction rate.

7. A clock according to claim 6; wherein the intermediate gear train comprises three gear-and-pinion units.

8. A clock according to claim 4; wherein a part of the circumferentially spaced projections extends outside of the base.

* * * * *